US008364475B2

(12) United States Patent
Togawa et al.

(10) Patent No.: US 8,364,475 B2
(45) Date of Patent: Jan. 29, 2013

(54) VOICE PROCESSING APPARATUS AND VOICE PROCESSING METHOD FOR CHANGING ACCOUSTIC FEATURE QUANTITY OF RECEIVED VOICE SIGNAL

(75) Inventors: Taro Togawa, Kawasaki (JP); Takeshi Otani, Kawasaki (JP); Kaori Endo, Kawasaki (JP); Yasuji Ota, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 586 days.

(21) Appl. No.: 12/631,050

(22) Filed: Dec. 4, 2009

(65) Prior Publication Data

US 2010/0082338 A1 Apr. 1, 2010

(30) Foreign Application Priority Data

Dec. 9, 2008 (JP) ..... 2008-313607

(51) Int. Cl.
*G10L 19/12* (2006.01)

(52) U.S. Cl. ..... 704/221

(58) Field of Classification Search ..... 704/221
See application file for complete search history.

(56) References Cited

U.S. PATENT DOCUMENTS

| | | | | |
|---|---|---|---|---|
| 5,781,885 | A | 7/1998 | Inoue et al. | |
| 7,672,846 | B2 * | 3/2010 | Washio et al. | 704/251 |

FOREIGN PATENT DOCUMENTS

| | | |
|---|---|---|
| JP | 59-216242 | 12/1984 |
| JP | 6-252987 | 9/1994 |
| JP | 7-181998 | 7/1995 |
| JP | 9-152890 | 6/1997 |
| JP | 10-78791 | 3/1998 |
| JP | 2004-219506 | 8/2004 |

* cited by examiner

*Primary Examiner* — Susan McFadden
(74) *Attorney, Agent, or Firm* — Staas & Halsey LLP

(57) ABSTRACT

A voice processing apparatus, which processes a first voice signal, includes: an acoustic analysis part which analyzes a feature quantity of an input second voice signal; a reference range calculation part which calculates a reference range based on the feature quantity; a comparing part which compares the feature quantity and the reference range and outputs a comparison result; and a voice processing part which processes and outputs the input first voice signal based on the comparison result.

15 Claims, 7 Drawing Sheets

| COMPARISON RESULT | AMOUNT OF CHANGE OF RECEIVING VOLUME |
|---|---|
| SPEAKING SPEED OF CURRENT FRAME IS SLOWER THAN REFERENCE RANGE (DIFFERENCE IS NOT LESS THAN Th) | AMPLIFICATION FACTOR: 2.0 |
| SPEAKING SPEED OF CURRENT FRAME IS SLOWER THAN REFERENCE RANGE (DIFFERENCE IS LESS THAN Th) | AMPLIFICATION FACTOR: 1.5 |
| SPEAKING SPEED OF CURRENT FRAME IS WITHIN REFERENCE RANGE | NO CHANGE |

VOICE PROCESSING APPARATUS AND VOICE PROCESSING METHOD FOR CHANGING ACOUSTIC FEATURE QUANTITY OF RECEIVED VOICE SIGNAL

CROSS-REFERENCE TO RELATED APPLICATIONS

This application is based upon and claims the benefit of priority from the prior Japanese Patent Application No. 2008-313607 filed on Dec. 9, 2008, the entire contents of which are incorporated herein by reference.

FIELD

This invention relates to, in a voice communication system, a voice processing technique for changing an acoustic feature quantity of a received voice and making the received voice easy to hear.

BACKGROUND

For example, Japanese Patent Laid-Open Publication No. 9-152890 discloses, in the voice communication system, a method of, when a user desires low speed conversation, reducing the speaking speed of a received voice in accordance with the difference of the speaking speed between the received voice and a transmitted voice, whereby the received voice is made easy to hear.

FIG. 7 is a configuration diagram of a first prior art for realizing the above method. In FIG. 7, the speaking speed of a receiving signal and the speaking speed of a transmission signal, which is obtained by conversion of a transmitted voice through a microphone 702, are calculated respectively by speaking speed calculation parts 701 and 703.

A speed difference calculation part 704 detects a difference in speed between the speaking speeds calculated by the speaking speed calculation parts 701 and 703. A speaking speed conversion part 705 then converts the speaking speed of the receiving signal based on a control signal corresponding to the speed difference calculated by the speed difference calculation part 704 and outputs a signal, which is obtained by the conversion and serves as a received voice, from a speaker 706 including an amplifier.

When a predetermined receiving volume is used, a received voice is sometimes buried in ambient noise, and thus may be hard to hear. Therefore, in order to make the received voice easy to hear, a speaker should speak with a loud voice, or a hearer should manually adjust the receiving volume by, for example, turning up the volume. Thus, for example, Japanese Patent Laid-Open Publication No. 6-252987 discloses a method of automatically making a received voice easy to hear. In this method, the tendency that a hearer speaks generally louder when a received voice is hard to hear (Lombard effect) is used, and when a transmitted voice level is not less than a predetermined reference value, the receiving volume is increased, whereby the received voice is automatically made easy to hear.

FIG. 8 is a configuration diagram of a second prior art for realizing the above method. FIG. 8 is a configuration example of a voice communication system such that, a voice signal, which is transmitted and received with respect to a communication network 801 through a communication interface part 802, is input and output in a transmission part 805 and a receiving part 806. For example when the system is a cell phone, an overall control part 804 controls calling and so on based on key input information input from a key input part 803 for inputting a phone number and so on.

In FIG. 8, a transmitted voice level detection part 807 detects a transmitted voice level of a transmission signal output from the transmission part 805. Under the control of the overall control part 804, a received voice level management part 808 generates a control signal for controlling a received voice level based on the transmitted voice level detected by the transmitted voice level detection part 807.

A received voice amplifying part 809 controls an amplification degree of a received signal, which is received from the communication network 801 through the communication interface part 802, based on the control signal of the received voice level output from the received voice level management part 808.

The receiving part 806 then outputs a received voice from a speaker (not shown) based on the received signal with the controlled received voice level received from the received voice amplifying part 809.

SUMMARY

A voice processing apparatus, which processes a first voice signal, includes: an acoustic analysis part which analyzes a feature quantity of an input second voice signal; a reference range calculation part which calculates a reference range based on the feature quantity; a comparing part which compares the feature quantity and the reference range and outputs a comparison result; and a voice processing part which processes and outputs the input first voice signal based on the comparison result.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF THE EMBODIMENTS

Figure 1:
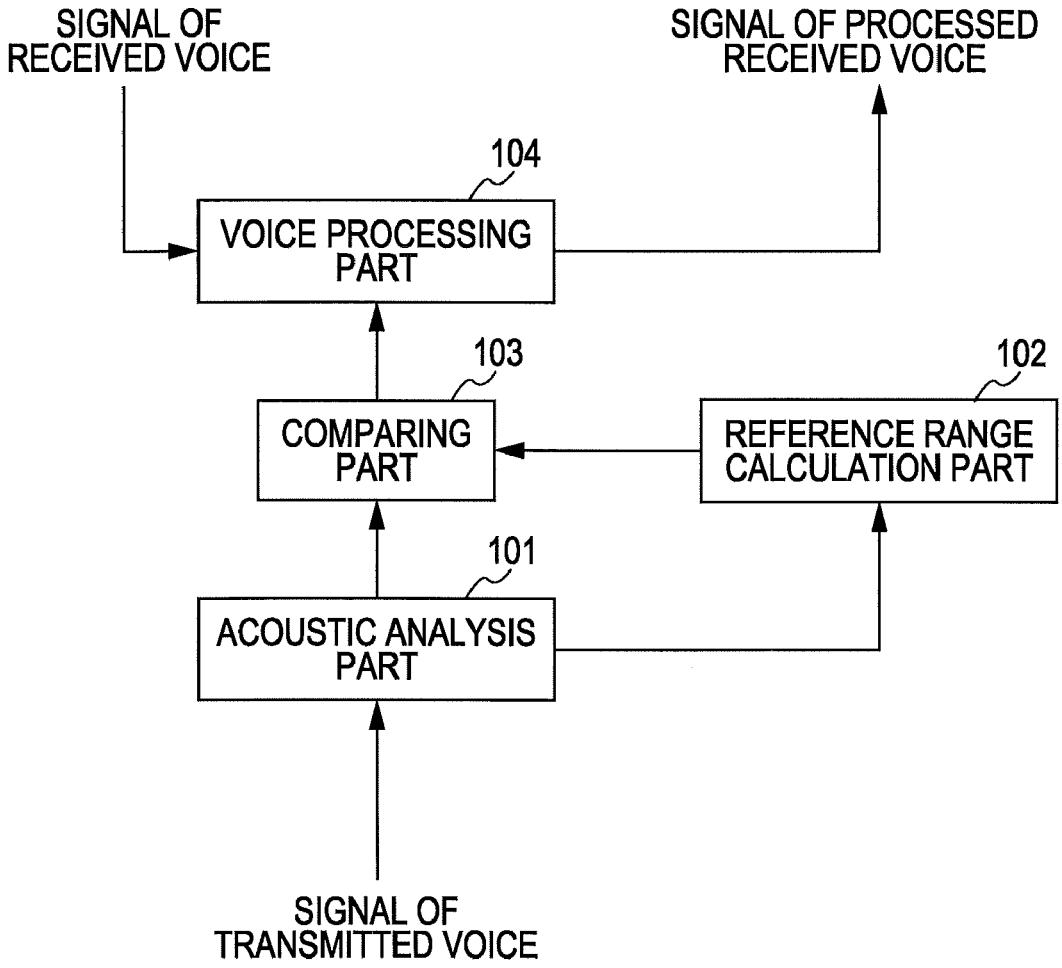
FIG. 1 is a configuration diagram of a first embodiment.

Hereinafter, a best mode for carrying out the invention will be described in detail with reference to the drawings. FIG. 1 is a configuration diagram of a first embodiment. An acoustic analysis part 101 analyzes a feature quantity of a signal of an input transmitted voice. More specifically, the acoustic analysis part 101 time-divides a transmitted voice and applies acoustic analysis to the time-divided transmitted voice to calculate the feature quantity such as a speaking speed and a pitch frequency.

A reference range calculation part 102 performs statistic processing related to an average value and dispersion and the like, with respect to the feature quantity calculated by the acoustic analysis part 101, and calculates a reference range. A comparing part 103 compares the feature quantity calculated by the acoustic analysis part 101 and the reference range calculated by the reference range calculation part 102, and outputs the comparison result.

Based on the comparison result output by the comparing part 103, a voice processing part 104 applies a specific processing treatment to the signal of the input received voice, so that the received voice is processed to be easy to hear, and the voice processing part 104 then outputs the processed received voice. The specific processing treatment includes, for example, sound volume changes, speaking speed conversion, and/or a pitch conversion.

Figure 2:
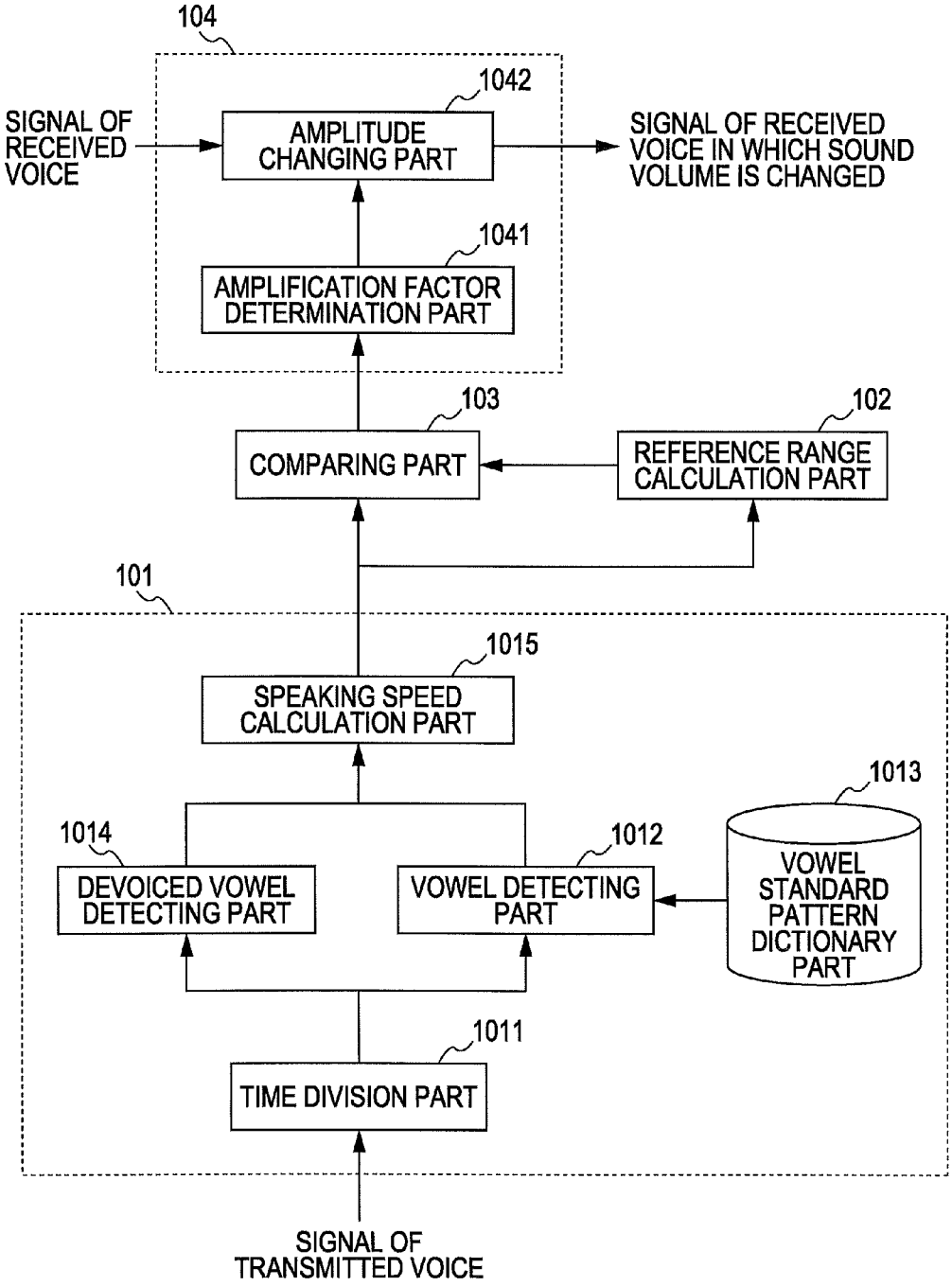
FIG. 2 is a configuration diagram of a second embodiment.

FIG. 2 is a configuration diagram of a second embodiment. A voice processing apparatus of the second embodiment may change a sound volume of the received voice in accordance with the speaking speed of the transmitted voice. In FIG. 2, the components 101, 102, 103, and 104 correspond to the parts with the same reference numerals in FIG. 1.

In FIG. 2, an acoustic analysis part 101 includes a time division part 1011, a vowel detecting part 1012, a vowel standard pattern dictionary part 1013, a devoiced vowel detecting part 1014, and a speaking speed calculation part 1015.

The voice processing part 104 includes an amplification factor determination part 1041 and an amplitude changing part 1042. The operation of the voice processing apparatus illustrated in FIG. 2 is described based on an operational flow chart of FIG. 3.

First, in the acoustic analysis part 101, when a signal of a transmitted voice is input (step S301 of FIG. 3), the time division part 1011 illustrated in FIG. 2 time-divides the signal of the transmitted voice into a specific frame unit.

Next, the vowel detecting part 1012 detects a vowel part from the input transmitted voice, which is output from the time division part 1011 and has been time-divided into frame units, with the use of the vowel standard patterns stored in the vowel standard pattern dictionary part 1013. More specifically, the vowel detecting part 1012 calculates LPC (Linear Predictive Coding) cepstral coefficients of each frame obtained by division in the time division part 1011. The vowel detecting part 1012 then calculates, for each frame, a Euclidean distance between the LPC cepstral coefficients and each vowel standard pattern of the vowel standard pattern dictionary part 1013. Each of the vowel standard patterns is previously calculated from the LPC cepstral coefficient of each vowel and is stored in the vowel standard pattern dictionary part 1013. When the minimum value of the Euclidean distance is smaller than a specific threshold value, the vowel detecting part 1012 determines there is a vowel in the frame.

In parallel with the processing performed by the vowel detecting part 1012, the devoiced vowel detecting part 1014 detects a devoiced vowel portion from the input transmitted voice which is output from the time division part 1011 and time-divided into frame units. The devoiced vowel detecting part 1014 detects fricative consonants (such as /s/, /sh/, and /ts/) by zero crossing count analysis. When plosive consonants (such as /p/, /t/, and /k/) follow fricative consonants, the devoiced vowel detecting part 1014 determines there is a devoiced vowel in the input transmitted voice.

Figure 3:
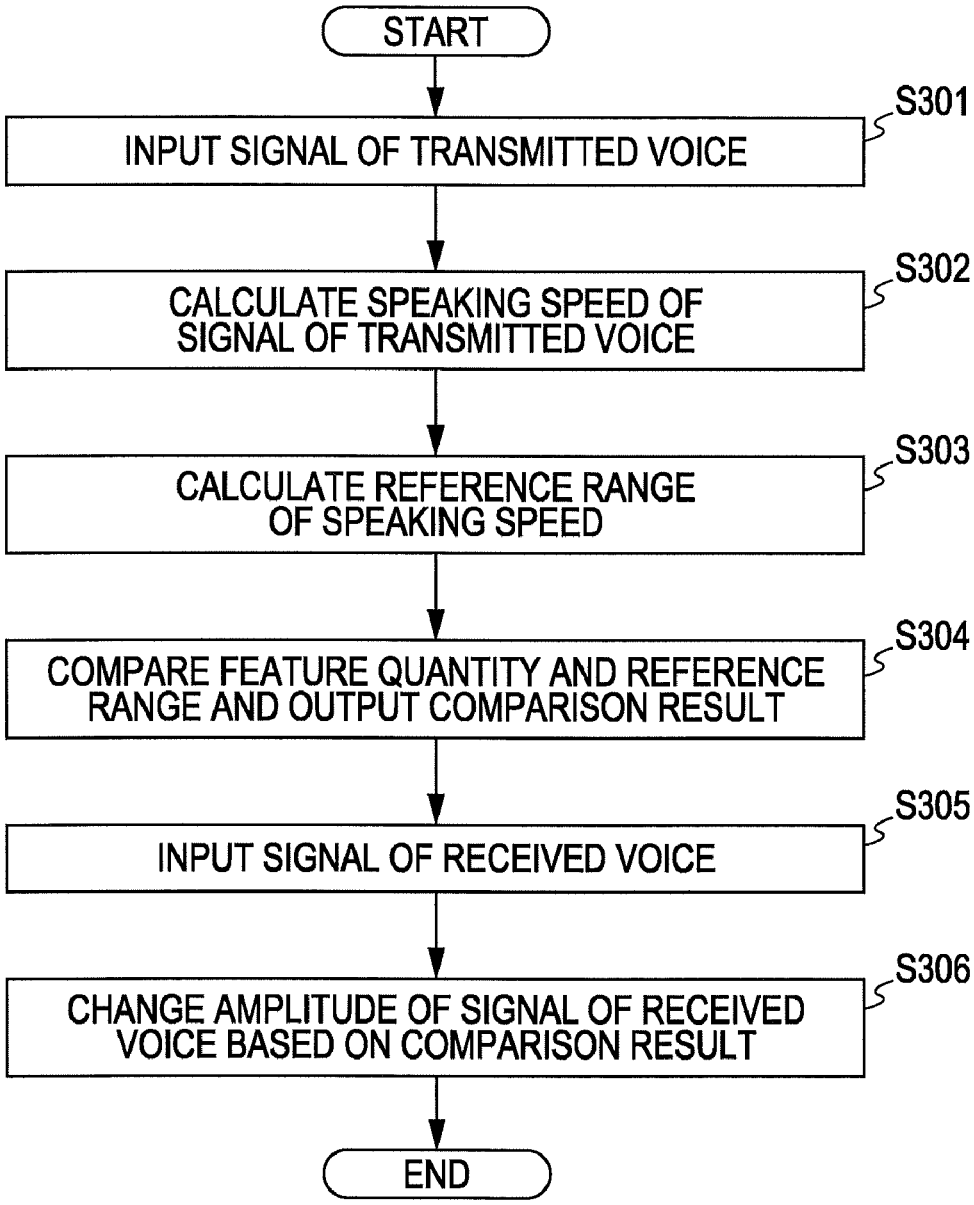
FIG. 3 is an operational flow chart illustrating operation of the second embodiment.

The speaking speed calculation part 1015 then counts the number of vowels and the devoiced vowels for a specific time based on the outputs of the vowel detecting part 1012 and the devoiced vowel detecting part 1014, whereby the speaking speed calculation part 1015 calculates the speaking speed (step S302 of FIG. 3).

The reference range calculation part 102 outputs a reference range with respect to the speaking speed calculated by the acoustic analysis part 101 (step S303 of FIG. 3). The comparing part 103 compares the speaking speed output from the acoustic analysis part 101 and the reference range calculated by the reference range calculation part 102 and outputs the comparison result (step 5304 of FIG. 3).

Figures 4, 5:
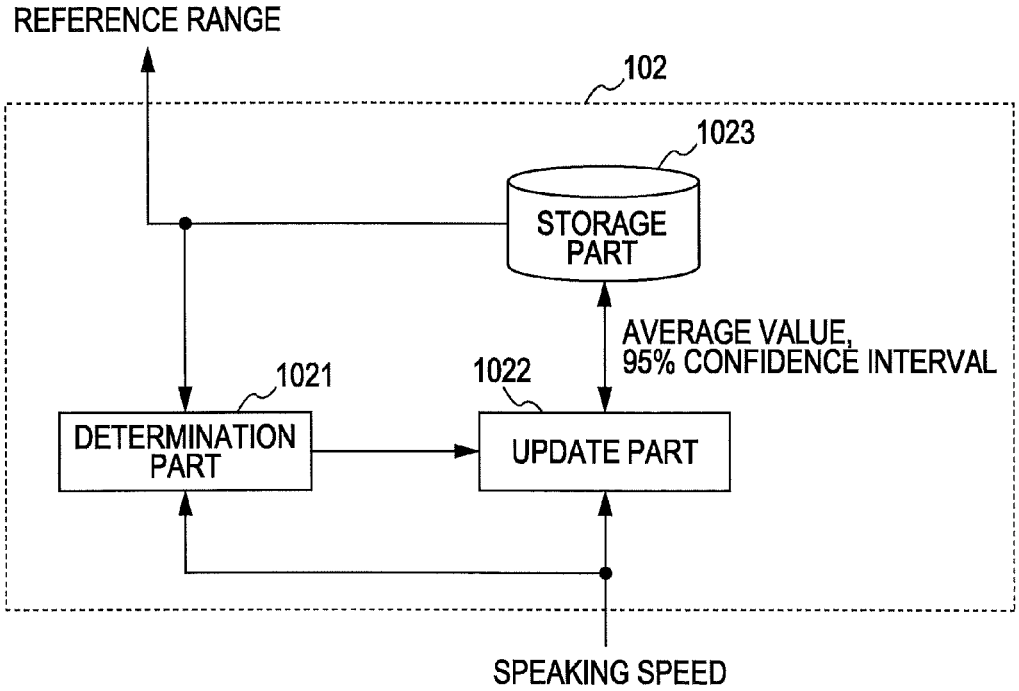
FIG. 4 is an explanatory view illustrating an example of receiving volume change operation in a voice processing part.
FIG. 5 is a configuration diagram of a reference range calculation part.

Based on the comparison result output from the comparing part 103, the voice processing part 104 inputs the received voice (step S305 of FIG. 3) and changes the amplitude (step S306 of FIG. 3). FIG. 4 illustrates an example of a receiving volume change operation in the voice processing part 104. When the speaking speed of the current frame obtained by time-division in the time division part 1011 is within the reference range, the receiving volume is not changed. When the speaking speed is slower than the reference range, control is performed so that the receiving volume is amplified. Further, when there is a difference of not less than a specific threshold value Th between the speaking speed of the current frame and the reference range, control is performed so that the amplitude is increased. Accordingly, when the speaking speed of the transmitted voice is reduced, the receiving volume is increased in a stepwise manner, and thus control may be performed naturally. In addition, when the amplification factor is changed, the amplification factor may be gradually changed in short time units obtained by further dividing the frame.

Figure 6:
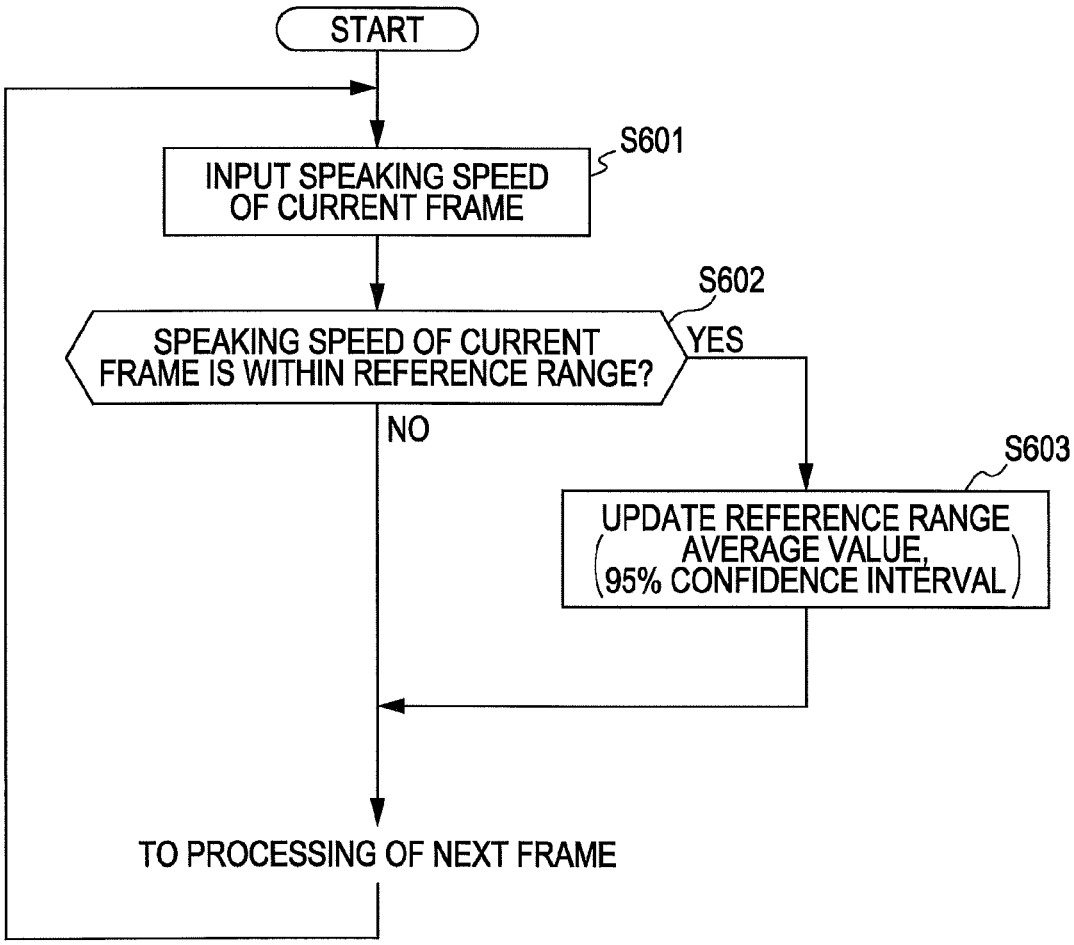
FIG. 6 is an operational flow chart illustrating operation of the reference range calculation part.
Figure 7:
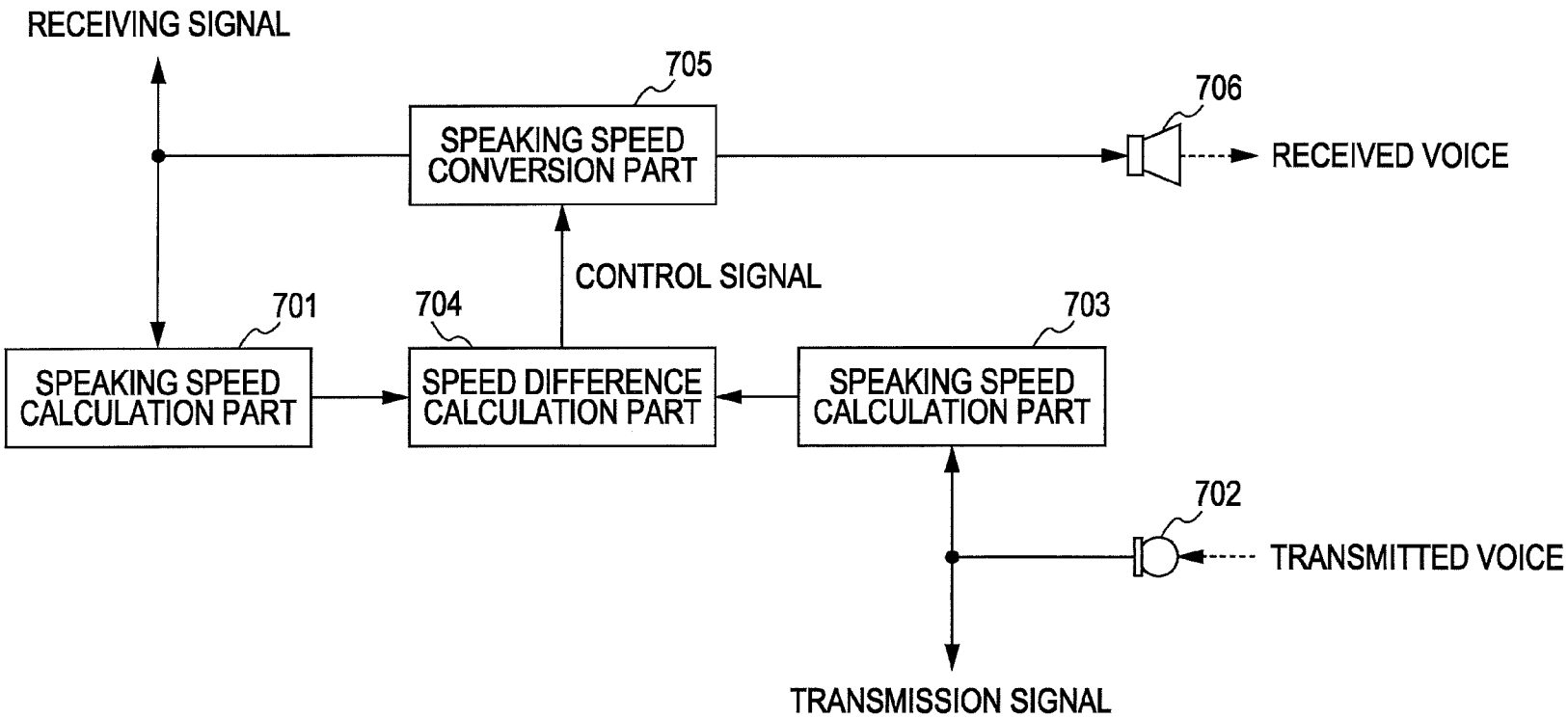
FIG. 7 is a configuration diagram of a first prior art.
Figure 8:
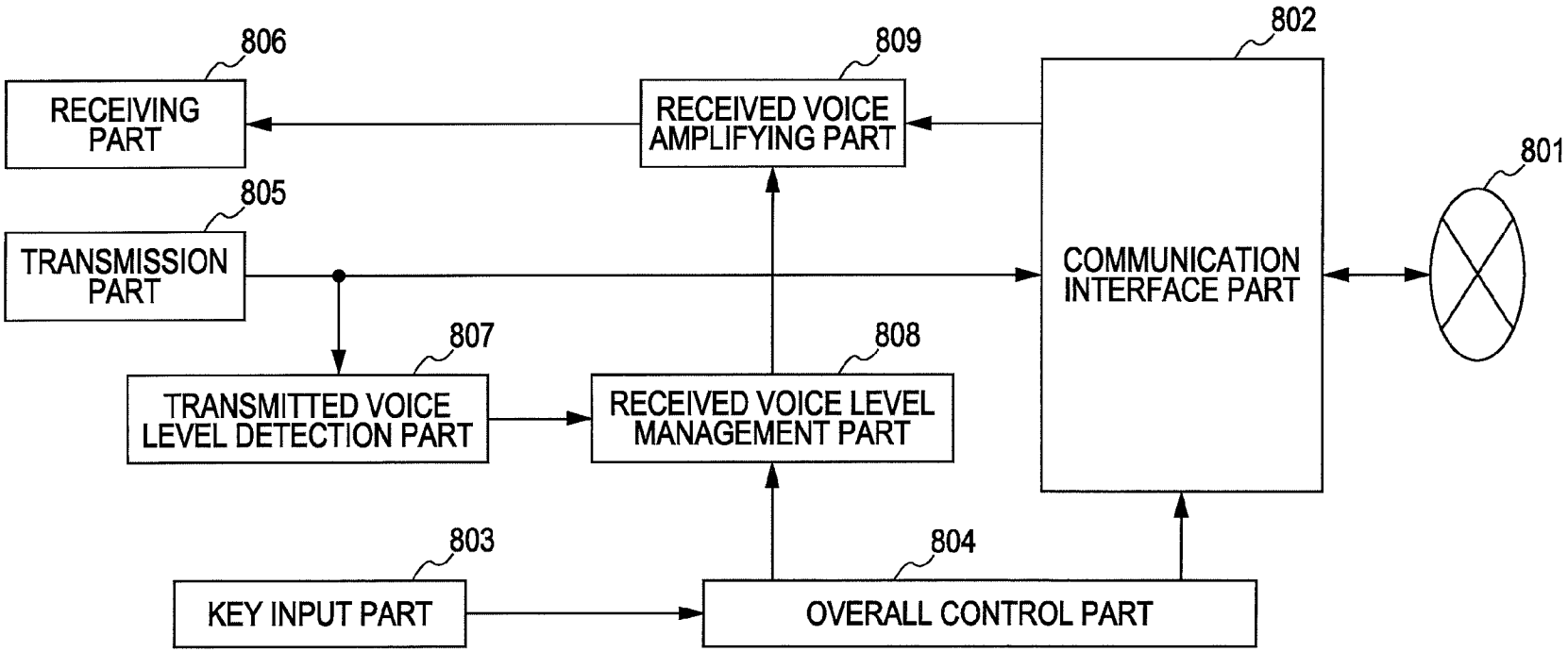
FIG. 8 is a configuration diagram of a second prior art.

FIG. 5 is a configuration diagram of the reference range calculation part 102 illustrated in FIG. 1 or 2. FIG. 6 is an operational flow chart illustrating operation of the reference range calculation part 102. In FIGS. 5 and 6, a determination part 1021 first inputs the speaking speed of the current frame from the acoustic analysis part 101 (step S601 of FIG. 6). The determination part 1021 then determines whether the speaking speed is within a reference range (step S602 of FIG. 6).

When the speaking speed is within the reference range, an update part 1022 updates the reference range (95% confidence interval from an average value) in accordance with the following formulae (1) to (4) with use of the speaking speed of the current frame (step S603 of FIG. 6).

$$\text{Reference range}=[m-k\times SE,\ m+k\times SE] \tag{1}$$

$$m=\frac{\sum_{i=1}^{N} sr_i}{N} \tag{2}$$

$$SE=\frac{SD}{\sqrt{N}} \tag{3}$$

$$SD=\sqrt{\frac{\sum_{i=1}^{N}(sr_i-m)^2}{N-1}} \tag{4}$$

where the meanings of the symbols in the formulae (1) to (4) are as follows:

- $sr_i$: the speaking speed from the current frame to the i-th past frame;
- N: the number of frames used in the calculation of a reference value;
- m: an average value of the speaking speed;
- k: a constant determined by reliability and the number of samples (when the reliability is 95% and the number of samples is ∞, the constant is 1.96);
- SE: standard errors of the mean; and
- SD: standard deviation.

In the operation example of FIG. 6, the 95% confidence interval is used in the reference range, however, a 99% confidence interval or other statistics related to dispersion may be used.

In the second embodiment, the acoustic analysis part 101 calculates the speaking speed of the transmitted voice. In a third embodiment to be hereinafter described, the acoustic analysis part 101 calculates the pitch frequency. Hereinafter, the configuration of the third embodiment is similar to FIG. 1 of the first embodiment.

For example, when a human exhales a large amount of air from the lungs for the purpose of raising his/her voice under a noisy environment, the vibration frequency of the vocal cord is increased, whereby the voice is naturally high-pitched. Thus, in the third embodiment, when the pitch frequency increases, the receiving volume is increased, whereby the received voice is made easy to hear.

A processing for calculating the pitch frequency of a transmitted voice in the acoustic analysis part 101 is illustrated as follows.

$$\mathrm{corr}(a) = \frac{\sum_{i=0}^{M-1} x(i-a)x(i)}{\sqrt{\sum_{i=0}^{M-1} x(i-a)^2}\sqrt{\sum_{i=0}^{M-1} x(i)^2}} \tag{5}$$

$$\mathrm{Pitch}=\mathrm{freq}/a_\mathrm{max} \tag{6}$$

wherein the meanings of the symbols in the formulae (5) and (6) are as follows:

x: a signal of a transmitted voice;

M: a length of an interval for calculation of a correlation coefficient (sample);

a: a starting position of a signal for calculation of the correlation coefficient;

pitch: the pitch frequency (Hz)

corr(a): a correlation coefficient at the time when a shifting position is "a":

a_max: "a" corresponding to the maximum correlation coefficient;

i: an index of a signal (sample); and freq: a sampling frequency (Hz).

As described above, the acoustic analysis part 101 calculates the correlated coefficient of the signal of the transmitted voice and divides the sampling frequency by the shifting position a corresponding to the correlated coefficient with the maximum value, whereby the pitch frequency is calculated.

The reference range calculation part 102 illustrated in FIG. 1 applies the statistic processing, which is similar to the formulae (1) to (4) in the description of the second embodiment, to the pitch frequency calculated in the acoustic analysis part 101 and consequently calculates the reference range.

Subsequently, the comparing part 103 compares the pitch frequency calculated by the acoustic analysis part 101 and the reference range of the pitch frequency calculated by the reference range calculation part 102 and outputs the comparison result.

Based on the comparison result obtained by the comparing part 103, the voice processing part 104 then applies a specific processing treatment to the signal of the input received voice, so that the received voice is processed to be easy to hear, and the voice processing part 104 then outputs the processed received voice. The specific processing treatment includes, for example, sound volume changes, speaking speed conversion, and/or pitch conversion processing.

In a fourth embodiment to be hereinafter described, the acoustic analysis part 101 calculates a slope of the power spectrum. Hereinafter, the configuration of the fourth embodiment is similar to FIG. 1 of the first embodiment.

According to the fourth embodiment, when a speaker wants to reduce a sound volume of the received voice, the speaker, for example, speaks in a muffled voice, whereby a high-frequency component is reduced, and the slope of the power spectrum is increased. Consequently, control may be performed so that the receiving volume is reduced.

The processing of calculating the slope of the power spectrum of a transmitted voice in the acoustic analysis part 101 is illustrated as follows:

(1) the power spectrum of the transmitted voice is calculated for each frame by time-frequency transform processing such as Fourier transform;

(2) a slope "a" of the power spectrum of the transmitted voice is calculated. Specifically, the frequency [Hz] of the i-th power spectrum calculated in (1) is represented by xi, and the magnitude of the i-th power spectrum [dB] is represented by yi. When the power spectrum of each frequency is represented by (xi, yi), the slope "a" of the power spectrum of the transmitted voice, which is a slope at the time when a linear function is applied, is calculated within a specific high frequency range on two-dimensional coordinates determined by xi and yi by means of a least-square method.

The reference range calculation part 102 illustrated in FIG. 1 applies the statistic processing, which is similar to the formulae (1) to (4) in the description of the second embodiment above, to the slope of the power spectrum calculated by the acoustic analysis part 101 and consequently calculates the reference range.

Subsequently, the comparing part 103 compares the slope of the power spectrum calculated by the acoustic analysis part 101 and the reference range of the slope of the power spectrum calculated by the reference range calculation part 102 and outputs the comparison result.

Based on the comparison result obtained by the comparing part 103, the voice processing part 104 then applies a specific processing treatment to the signal of the input received voice, so that the received voice is processed to be easy to hear, and the voice processing part 104 then outputs the processed received voice. The specific processing treatment includes, for example, sound volume changes, speaking speed conversion, and/or pitch conversion processing.

In a fifth embodiment to be hereinafter described, the acoustic analysis part 101 calculates an interval of a transmitted voice. Hereinafter, the configuration of the fifth embodiment is similar to FIG. 1 of the first embodiment.

According to the fifth embodiment, when a speaker wants to increase the sound volume of a received voice, the speaker, for example, speaks in intervals, whereby control may be performed so that the interval is detected to increase the receiving volume.

The processing of calculating the interval of the transmitted voice in the acoustic analysis part 101 is illustrated as follows.

(1) A voice interval of a transmitted voice is detected. Specifically, a frame power is compared with a threshold value calculated as a long-term average of the frame power, whereby the voice interval is determined.

(2) The length of the interval is calculated as a continuous length of a voiceless interval.

The reference range calculation part 102 illustrated in FIG. 1 applies the statistic processing, which is similar to the formulae (1) to (4) in the description of the second embodiment above, to the length of the interval calculated by the acoustic analysis part 101 and consequently calculates the reference range.

Subsequently, the comparing part 103 compares the length of the interval calculated by the acoustic analysis part 101 and the reference range of the length of the interval calculated by the reference range calculation part 102 and outputs the comparison result. Based on the comparison result calculated by the comparing part 103, the voice processing part 104 then applies specific processing treatment to the signal of the input received voice, so that the received voice is processed to be easy to hear, and the voice processing part 104 then outputs the processed received voice. The specific processing treatment includes, for example, sound volume changes, speaking speed conversion, and/or pitch conversion processing.

In the second embodiment described above, the voice processing part 104 changes the sound volume of the received voice. In a sixth embodiment to be hereinafter described, the voice processing part 104 changes the speaking speed. Hereinafter, the configuration of the sixth embodiment is similar to FIG. 1 of the first embodiment.

The speaking speed of a signal of a received voice changed by the voice processing part 104 may be realized by the configuration disclosed in, for example, Japanese Patent Laid-Open Publication No. 7-181998. Specifically, processing such that a time axis of a received voice waveform is compressed to increase the speaking speed is realized by the following configuration.

Namely, a pitch extraction part extracts a pitch period T from an input voice waveform, which is a received voice. A time-axis compression part creates and outputs a compression voice waveform from the input voice waveform based on the following first to sixth processes.

First process: the input voice waveform of an amount nT from the current pointer is cut out as a first voice waveform.

Second process: the current pointer is moved by an amount T.

Third process: the input voice waveform of the amount nT from the current pointer is cut out as a second voice waveform.

Fourth process: the first and second voice waveforms are weighted and summed to be output as the compression voice waveform.

Fifth process: the input voice waveform from the end point of the second voice waveform to a point moved from the end point by (Lc-nT) is output as the compression voice waveform.

Sixth process: the current pointer is moved by an amount Lc, and the processing returns to the first process.

Note that in the above processes, $Lc=rT/(1-r)$, $Lc \geqq nT$, $n \geqq 2$ (n: integer), Lc is a pointer travel amount, r is a compression rate, and T is a pitch period.

Meanwhile, the processing of expanding the time axis of the received voice waveform and reducing the speaking speed is realized by the following configuration.

Namely, the pitch extraction part extracts the pitch period T from the input voice waveform, which is a received voice. A time-axis expansion part creates and outputs an expansion voice waveform from the input voice waveform based on the following first to fifth processes.

First process: the input voice waveform of an amount nT from the point returned from the current pointer by an amount T is cut out as a first voice waveform.

Second process: the input voice waveform of the amount nT from the current pointer is cut out as a second voice waveform.

Third process: the first and second voice waveforms are weighted and summed to be output as the expansion voice waveform.

Fourth process: the input voice waveform from the end point of the second voice waveform to the point returned from the end point by (Ls-T) is output as the expansion voice waveform.

Fifth process: the current pointer is moved by an amount Ls, and the processing returns to the first process.

Note that in the above processes, $Ls=T/(r-1)$, $Ls \geqq T$, $n \geqq 2$ (n: integer), Ls: a pointer travel amount, r: an expansion rate, and T: a pitch period.

In the second embodiment described above, the voice processing part 104 changes the sound volume of the received voice, and in the sixth embodiment described above, the voice processing part 104 changes the speaking speed of the received voice. In a seventh embodiment to be hereinafter described, the voice processing part 104 changes the pitch frequency. Hereinafter, the configuration of the seventh embodiment is similar to FIG. 1 of the first embodiment.

The pitch frequency of a signal of a received voice changed by the voice processing part 104 may be realized by the configuration disclosed in, for example, Japanese Patent Laid-Open Publication No. 10-78791.

Specifically, a first pitch conversion part cuts out a phoneme waveform from a voice waveform, which is a received voice, and repeatedly outputs the phoneme waveform with a period corresponding to a first control signal.

A second pitch conversion part is connected to the input or output side of the first pitch conversion part, and the voice waveform is expanded and output in the time axis direction at a rate corresponding to a second control signal.

A control part then determines a desired pitch conversion ratio S0 and a conversion ratio F0 of a desired formant frequency based on the output of the comparing part 103 to give the conversion ratio FO as the second control signal to the second pitch conversion part. The control part further gives to the first pitch conversion part a signal as the first control signal which instructs the output performed with a period corresponding to S0/F0.

In the second embodiment described above, the voice processing part 104 changes the sound volume of the received voice. In the sixth embodiment described above, the voice processing part 104 changes the speaking speed of the received voice. In the seventh embodiment described above, the voice processing part 104 changes the pitch frequency of the received voice. In an eighth embodiment to be hereinafter described, the voice processing part 104 changes the length of the interval of the signal of a received voice. Hereinafter, the configuration of the eighth embodiment is similar to FIG. 1 of the first embodiment.

The length of the interval of the signal of the received voice may be changed by the voice processing part 104 as follows, for example. Namely, the length of the interval of the received voice is changed by further addition of the interval after termination of the interval of the received voice. According to this configuration, a time delay occurs in the output of the next received voice; however, a long interval which is caused by the intake of a breath and is not less than a certain period of time is reduced, whereby the time delay is recovered.

In the second embodiment described above, the voice processing part 104 changes the sound volume of the received voice. In the sixth embodiment described above, the voice processing part 104 changes the speaking speed of the received voice. In the seventh embodiment described above, the voice processing part 104 changes the pitch frequency of the received voice. In the eighth embodiment, the voice processing part 104 changes the length of the interval of the signal of the received voice. In a ninth embodiment to be hereinafter described, the voice processing part 104 changes the slope of the power spectrum of the signal of a received voice. Hereinafter, the configuration of the ninth embodiment is similar to FIG. 1 of the first embodiment.

The slope of the power spectrum of the signal of a received voice may be changed by the voice processing part 104 as follows, for example.

(1) The power spectrum of the received voice is calculated by time-frequency conversion processing such as Fourier transform.

(2) The slope of the power spectrum of the received voice is changed by the following formula:

$$pr_i' = pr_i + \Delta a \times i \quad (7),$$

wherein the meaning of the symbols in the formula (7) are as follows:

$pr_i'$: the power spectrum in the i-th band of the received voice after the change of the slope;

$pr_i$:the power spectrum in the i-th band of the received voice;

i: an index in the band of the power spectrum; and

Δa: the amount of change of the slope (dB/band).

(3) The power spectrum of the received voice modified in (2) is converted into a time region signal by frequency-time conversion processing such as inverse Fourier transform.

In the first to ninth embodiments, the received voice is processed to be made easy to hear in accordance with the feature quantity of the input transmitted voice; however, a previously recorded and stored voice is processed in accordance with the feature quantity of the transmitted voice of a user, whereby the stored voice may also be made easy to hear when reproduced.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present inventions have been described in detail, it should be understood that the various changes, substitutions, and alterations could be made hereto without departing from the spirit and scope of the invention.

What is claimed is:

1. A voice processing apparatus, which processes a first voice signal, the apparatus comprising:

an acoustic analysis part which analyzes a feature quantity of an input second voice signal;

a reference range calculation part which calculates a reference range based on the feature quantity;

a comparing part which compares the feature quantity and the reference range and thereby outputs a comparison result; and a voice processing part which, using a processor, processes and outputs the input first voice signal based on the comparison result.

2. The voice processing apparatus as claimed in claim 1, wherein the reference range calculation part calculates an average value of the feature quantity as the reference range.

3. The voice processing apparatus as claimed in claim 2, wherein the reference range calculation part further calculates, as the reference range, a statistic representing dispersion of the feature quantity.

4. The voice processing apparatus as claimed in claim 1, wherein the reference range calculation part determines whether the feature quantity is within the reference range, and when the feature quantity is within the reference range, the reference range calculation part updates the reference range.

5. The voice processing apparatus as claimed in claim 1, wherein the acoustic analysis part calculates, as the feature quantity of the second voice signal, any one of a power, a speaking speed, a pitch frequency, a power spectrum, and a length of an interval of speaking.

6. The voice processing apparatus as claimed in claim 1, wherein the voice processing part changes at least any one of a power of the first voice signal, a speaking speed, a pitch frequency, a length of an interval of speaking, and a slope of a power spectrum.

7. The voice processing apparatus as claimed in claim 1, wherein the first voice signal is a received voice, and the second voice signal is a transmitted voice.

8. A voice processing method, which processes a first voice signal, comprising:

analyzing a feature quantity of an input second voice signal;

calculating a reference range based on the feature quantity;

comparing the feature quantity and the reference range; and processing, using a processor, the input first voice signal based on the comparing.

9. The voice processing method as claimed in claim 8, wherein in the calculating, an average value of the feature quantity is calculated as the reference range.

10. The voice processing method as claimed in claim 9, wherein in the calculating, a statistic representing dispersion of the feature quantity is further calculated as the reference range.

11. The voice processing method as claimed in claim 8, wherein in the calculating, whether the feature quantity is within the reference range is determined, and when the feature quantity is within the reference range, the reference range is updated.

12. The voice processing method as claimed in claim 8, wherein in the analyzing, any one of a power, a speaking speed, a pitch frequency, a power spectrum, and a length of an interval of speaking is calculated as the feature quantity of the second voice signal.

13. The voice processing method as claimed in claim 8, wherein in the processing, at least any one of a power, a speaking speed, a pitch frequency, a length of an interval of speaking, and a slope of a power spectrum, of the first voice signal is changed.

14. The voice processing method as claimed in claim 8, wherein the first voice signal is a received voice, and the second voice signal is a transmitted voice.

15. A voice processing apparatus, which processes a first voice signal, the apparatus comprising:

a processor; and a memory which stores a plurality of instructions, which when executed by the processor, cause the processor to execute:

analyzing a feature quantity of an input second voice signal, calculating a reference range based on the feature quantity, comparing the feature quantity and the reference range, and processing the input first voice signal based on a comparison result the comparing.

* * * * *

UNITED STATES PATENT AND TRADEMARK OFFICE

CERTIFICATE OF CORRECTION

PATENT NO. : 8,364,475 B2
APPLICATION NO. : 12/631050
DATED : January 29, 2013
INVENTOR(S) : Taro Togawa et al.

It is certified that error appears in the above-identified patent and that said Letters Patent is hereby corrected as shown below:

On the Title Page, item (54) and in the specification, Col. 1, Line 3, Title; Delete "ACCOUSTIC" and insert -- ACOUSTIC --, therefor.

Signed and Sealed this
Twenty-eighth Day of May, 2013

Teresa Stanek Rea
*Acting Director of the United States Patent and Trademark Office*